US005775844A

United States Patent [19]

Nelson

[11] Patent Number: 5,775,844

[45] Date of Patent: Jul. 7, 1998

[54] PIPELINE REPAIR HABITAT

[76] Inventor: Arthur Nelson, HC 37, Box 607, Lead, S. Dak. 57754

[21] Appl. No.: 785,660

[22] Filed: Jan. 17, 1997

[51] Int. Cl.[6] ..... B63C 11/34

[52] U.S. Cl. ..... 405/188; 405/192; 138/97; 138/99

[58] Field of Search ..... 138/97, 98, 99; 405/188, 191, 192, 216, 195.1

[56] References Cited

U.S. PATENT DOCUMENTS

| | | | |
|---|---|---|---|
| 2,667,751 | 2/1954 | Osborn | 405/188 |
| 3,328,970 | 7/1967 | Giambelluca, Jr. | 405/188 |
| 3,386,254 | 6/1968 | Connally | 405/188 |
| 3,473,338 | 10/1969 | Pearce, III | 405/188 |
| 3,525,388 | 8/1970 | McClintock | 405/192 |
| 3,599,436 | 8/1971 | Lochridge et al. | 405/188 |
| 3,641,777 | 2/1972 | Banjavich et al. | 405/188 |
| 5,079,824 | 1/1992 | Lopez et al. . | |
| 5,324,140 | 6/1994 | Lopez et al. | 405/188 |
| 5,400,735 | 3/1995 | Yamin et al. | 405/188 |

*Primary Examiner*—David Scherbel
*Assistant Examiner*—James F. Hook
*Attorney, Agent, or Firm*—Gene R. Woodle

[57] ABSTRACT

Embodiments of a pipeline repair habitat are disclosed which may be used to facilitate the repair of vertical underwater pipelines or risers. Two hollow, half-cylindrical shells are provided which form a stable, rigid shell around the section of pipe to be repaired. Structure is provided for introducing an atmosphere into the habitat which is breathable while most repairs are accomplished. Under certain conditions a non explosive atmosphere which is not breathable is introduced into the habitat so that welding may be safely performed. Various useful accessories are provided including an elevator by which a person accomplishing repairs may move up and down within the pipeline repair habitat.

5 Claims, 6 Drawing Sheets

PIPELINE REPAIR HABITAT

BACKGROUND OF THE INVENTION

1. Field of the Invention

The present invention relates generally to the field of pipelines and more particularly to a method for making repairs to damaged portions of such pipelines which form risers to drilling platforms.

2. Background Information

Throughout the world there are thousands of miles of pipelines carrying liquids and gases ranging from coal slurries to natural gas. In most cases these pipelines are made from hollow cylindrical metal sections laid end to end with the joints between sections welded. Such pipelines are laid in varying terrain and under various conditions. Some sections of pipeline are above the surface of the ground and some are buried. In other instances sections of pipeline run through swamps or along the bottom of relatively deep bodies of water. Pipeline diameters are fairly standard, but range in size from fifty-two inches to one or two inches.

In order to supplement supplies of gas and oil which may be accessed on land, an ncreasing number of oil and gas sources are being tapped which are off shore. Because ordinary drilling and pumping methods may not be used for these underwater sources, platforms are erected over the site and supported near the surface upon legs. The oil and gas is brought to the surface by means of risers which provide for the transport of oil or gas either from an underwater pipeline or from a well head to the surface. Most risers, like most pipelines, are made from cylindrical sections of steel pipe which are welded together at their ends. Risers ordinarily run near to and parallel with one of the legs which support the platform and are attached to the leg.

In nearly every case, pipelines and risers are regularly inspected for leaks and damaged or weakened sections and such sections repaired by replacing or patching affected areas. When a riser is used to transport materials such as oil and natural gas, leakage of such materials is likely to be exceedingly damaging to the environment as well as causing significant economic loss. When leaking, damaged, or weakened area of a riser must be repaired; the repair is difficult, dangerous, and expensive because such areas are under water, sometimes at significant depths. In some cases, riser repairs are made by emptying the affected line segment and removing and replacing the affected section. More often the repair is accomplished by placing a patch of some type over or around the affected area. In many cases the fluid flowing through a riser is sufficiently hot that the temperature of the outer section of the riser may be as hot as 170 degrees F.

The instant invention addresses the difficult problems involved in repairing a variety of risers. The most significant problem being the creation of an environment or habitat in which technicians may work underwater safely and in relative comfort.

At least one method of making underwater repairs to risers is known in the prior art as disclosed by the patent to Jose de Jesus Silva Lopez et al. (Mexican Pat. No. 157,246; Jan. 18, 1984). This device has a flexible shell which is configured in the shape of a hot air balloon. The top of the shell has a round hole in the middle and the hole includes a collar which may be fastened around the riser just above the section to be repaired. The bottom of the shell is open and attached to the riser by means of straps which are fastened to the riser below the shell. A umbilical from the surface comes up under the bottom of the shell to the interior of the shell. Air is pumped through the umbilical which inflates the shell and provides a working environment.

Although this prior art device does provide a method of creating a habitat which technicians may use when sealing or repairing damaged sections of risers, it does suffer from various defects or shortcomings. For example, in cases in which the repair must be made near the surface, the wave action on the surface may make the habitat dangerous or impossible to work in because of erratic and violent movement as well as drastic and rapid changes in gas pressure within the habitat.

The instant invention is a pipeline repair habitat which is unique, original, and fills the need for a new and improved method of creating a habitat in which leaking, damaged, or weakened areas in a pipeline riser may be repaired.

The ideal pipeline repair habitat should provide an environment in which risers may be repaired safely, comfortably, and efficiently. The ideal pipeline repair habitat should also provide an environment in which technicians may work without the necessity of wearing cumbersome diving equipment. The ideal pipeline repair habitat should also be secure and stable and not subject to movement caused by currents and wave action. The ideal pipeline repair habitat should also provide an environment which is comfortable and in which repairs may be accomplished efficiently. The ideal pipeline repair habitat should also be simple to use, uncomplicated, compact, and inexpensive.

SUMMARY OF THE INVENTION

The pipeline repair habitat of the instant invention provides a pair of half-cylindrical shells which may be placed around a leaking, damaged, or weakened area of a vertical riser. The shells are hinged at one edge and have latches at the opposite edge. The edges of the shells are provided with shell seals. There is a semicircular hole in the top or each shell having a diameter greater that the diameter of most risers. Two top collars, one for each shell, are bolted within the holes in the shells and form a seal around the riser. The bottoms of the two shells are open and two bottom collars, one for each shell, are attached to the bottoms of the shells to hold the bottoms of the shells firmly to the riser.

There is a hatch near the top of the outside surface of one of the shells and there is a top door in the top of the hatch and a bottom door which allows entry into the interior of the two shells. Both the top and bottom doors are provided with seals.

There are a plurality of vertical elevator rails affixed to the interior surfaces of both shells. Two elevator plates are also provided which are perpendicular to the longitudinal axis of the shells and which are slideable along the elevator rails. The elevator plates are powered by two electric winches which are attached to the tops of the shells and connected to the elevator plates by means of two elevator cables. In addition to the elevator plates which have foot operated controls, there are two ladders on the inside surfaces of the two shells.

Two air ducts are provided which are attached to the outer surfaces of the shells and which are in communication with the interior of the shells near the top and near the bottom of the shells. Each air duct has an incorporated blower and air scrubber. Each air duct further contains a cooling tube which circulates cooling liquid through the ducts.

A umbilical connects the interior of the shells to the surface and may be used for the transmission of electricity and air. The shell end of the umbilical splits and one end is attached to each of the elevator plates. The umbilical may carry a variety of services to the habitat including electricity, communications, television transmission, and air.

A plurality of braces are also provided which firmly affix the pipeline repair habitat to the leg to which the riser is attached.

In operation the shells are placed around the affected area of the riser with the habitat surrounding the leaking, damaged, or weakened area of the riser. The latches are used to close the habitat firmly around the riser and the seals in the shells and the collars provide an enclosed environment. The braces are affixed to the leg and the habitat to hold the habitat in place and to prevent the habitat from stressing the riser. The habitat is then filled with air using the umbilical. At this point both the upper and lower doors to the hatch are closed. A technician may then enter the hatch through the upper door. The upper door is then closed and the lower door opened and the technician enters the habitat. The lower door is then closed. The blowers circulate the air through the habitat and the scrubbers purify the air. The technician may perform the repairs inside the safe and comfortable habitat using either the ladders or the elevator plates to move up and down the inside of the habitat.

One of the major objectives of the instant invention is to provide an environment in which risers may be repaired safely, comfortably, and efficiently.

Another objective of the pipeline repair habitat is to provide an environment in which technicians may work without the necessity of wearing cumbersome diving equipment.

Another objective of the pipeline repair habitat to provide a working environment which is secure and stable and not subject to movement caused by currents and wave action.

Another objective of the pipeline repair habitat is to provide an environment which is comfortable and in which repairs may be accomplished efficiently.

Another objective of the pipeline repair habitat is to provide an environment which is simple to use, uncomplicated, compact, and inexpensive.

These and other features of the invention will become apparent when taken in consideration with the following detailed description and the drawings.

DESCRTIPTION OF A PREFERRED EMBODIMENT

Figure 1:
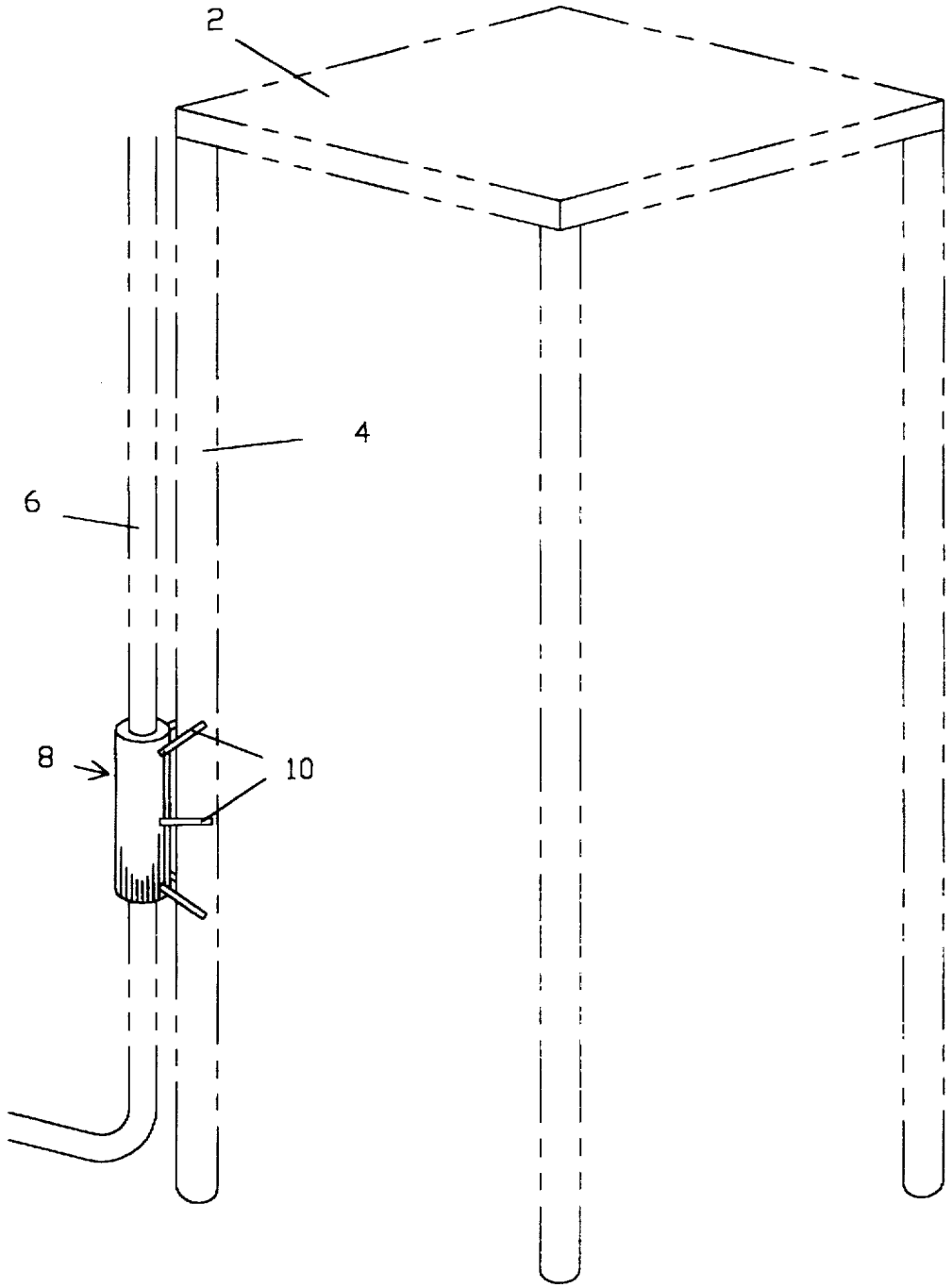
FIG. 1 is a perspective view of a preferred form of a the pipeline repair habitat of the present invention in operation.

Referring to the drawings, FIGS. 1 through 11, there is shown a preferred form of the pipeline repair habitat embodying the present invention.

Referring to FIG. 1, a perspective view of a preferred form of the present invention in operation is shown. A platform 2 is shown in phantom lines. Four legs 4 are shown in phantom lines which are the legs which support the platform 2. A riser 6 is also shown in phantom lines which is attached to the leg 4. The pipeline repair habitat 8 is shown in solid lines around the riser 6 and attached to said leg 4 by means of a plurality of braces 10.

Figure 2:
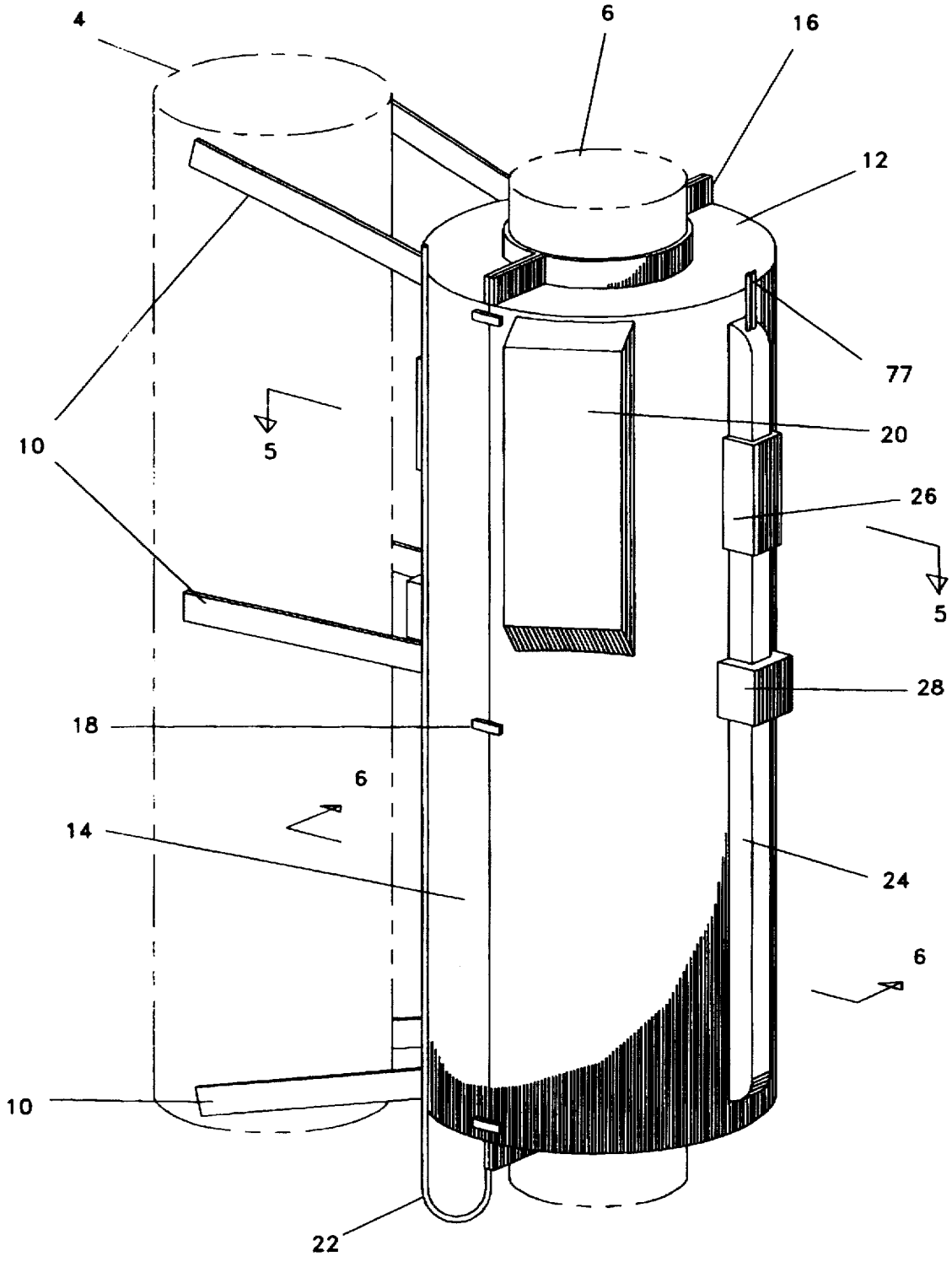
FIG. 2 is a perspective view of a preferred form of a the present invention.

Referring now to FIG. 2, a perspective view of a preferred form of the present invention is shown. The main structure of the pipeline repair habitat is made up of two half-cylindrical, hollow, shells; a hatch shell 12 and a shell 14. The tops of the hatch shell 12 and the shell 14 are fitted to said riser 6 by means of two top collars 16. One edge of said hatch shell 12 and said shell 14 are joined by a plurality of hinges 18 such that said hatch shell 12 and said shell 14 may be closed around said riser 6 using the hinges 18. A hatch 20 is attached to the outer surface of said hatch shell 12 near the top of said hatch shell 12. A umbilical 22 runs from the surface to the interior of the environment formed by said hatch shell 12 and said shell 14. There is a hollow air duct 24 attached to the outer surface of both said hatch shell 12 and said shell 14 which runs parallel to the longitudinal axis of said riser 6 and for most of the length of said hatch shell 12 and said shell 14. The air ducts 24 are in communication with the interior of the environment formed by said hatch shell 12 and said shell 14 at the top and bottom of said air ducts 24. A blower 26 and a scrubber 28 are interposed within each of said air ducts 24.

Figure 3:
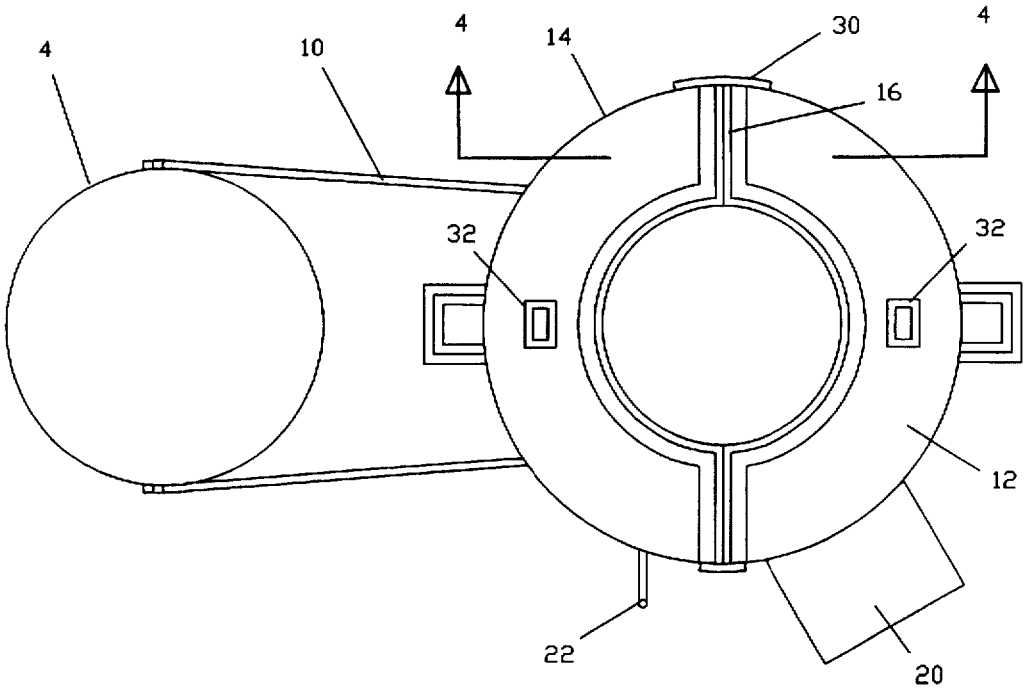
FIG. 3 is a top view of a preferred form of the present invention.

Referring now to FIG. 3, a top view of the pipeline repair habitat of the present invention is shown which shows the configuration of said leg 4 and said braces 10. There are a plurality of latches 30 affixed to the edges of said hatch shell 12 and said shell 14 opposite said hinges 18 which serve to close said hatch shell 12 and said hatch shell 14 around said riser 6 and the leaking, damaged, or weakened section of said riser 6. Two elevator winches 32 are affixed to the tops of said hatch shell 12 and said shell 14.

Figure 4:
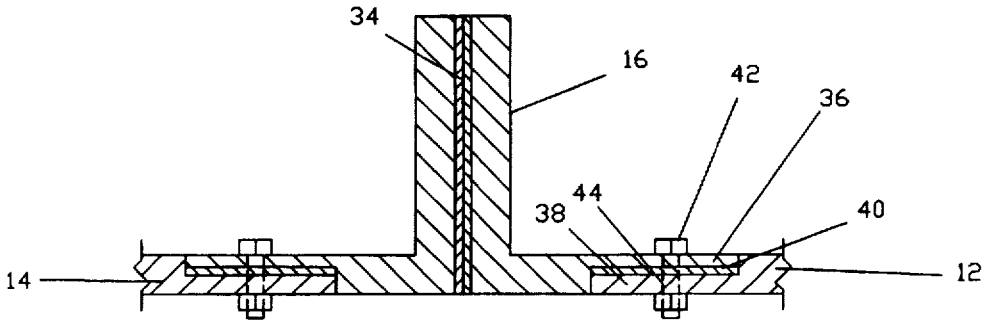
FIG. 4 is a partial sectional view of a portion of a preferred form of the present invention taken along line 4—4 of FIG. 3.

Referring now to FIG. 4, a partial sectional view of the pipeline repair habitat of the present invention taken alone line 4—4 of FIG. 3, a detailed sectional view of said top collars 16 is shown. In cross section said top collars 16 have the general shape of an "L" and there is a top collar seal 34 along the inner face of the vertical leg of the "L." The lower leg of the "L" includes a top collar lip 36 at the top of the outer end of the "L." There is also a shell top lip 38 on the bottom of the hole in the center of the top of said hatch shell 12 and said shell 14. A shell seal 40 fits between the top face of the shell top lip 38 and the bottom face of the top collar lip 36. Said top collars 16 are attached to said hatch shell 12 and said shell 14 by a plurality of bolts 42 through an equal number of holes 44 through said top collar lip 36 and said shell top lip 38.

Figure 5:
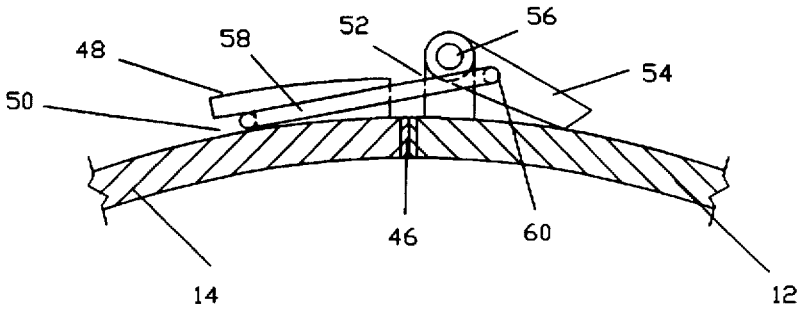
FIG. 5 is a partial sectional view of a portion of a preferred form of the present invention taken along line 5—5 of FIG. 2.

Referring now to FIG. 5 which is a partial sectional view of the pipeline repair habitat of the present invention taken along line 5-5 of FIG. 2 and shows a detailed view of the latch 30. There are shell seals 46 along the edges of said hatch shell 12 and said shell 14. There is a catch 48 attached to the outer surface of said shell 14 which has a slot 50 away from the edges of said hatch shell 12 and said shell 14. There is an arm 52 attached to said hatch shell 12 near the edge of said hatch shell 12. A handle 54 pivots about a pin 56 in the arm 52. A ring 58 is attached to the handle 54 through a latch hole 60 which is further from the edge of said hatch shell 12 than said arm 52 and is closer to the outer surface of said hatch shell 12 than said pin 56. When said handle 54 is rotated so that the end of the handle touches said hatch shell 12, the end of the ring 58 fits within the slot 50 and holds the edges of said hatch shell 12 and said shell 14 firmly together. When said handle 54 is rotated so that the end of said handle 54 is away from said hatch shell 12, said ring 58 is released from said slot 50 and said hatch shell 12 and said shell 14 may be opened upon said hinges 18 and swung away from said riser 6.

Figure 6:
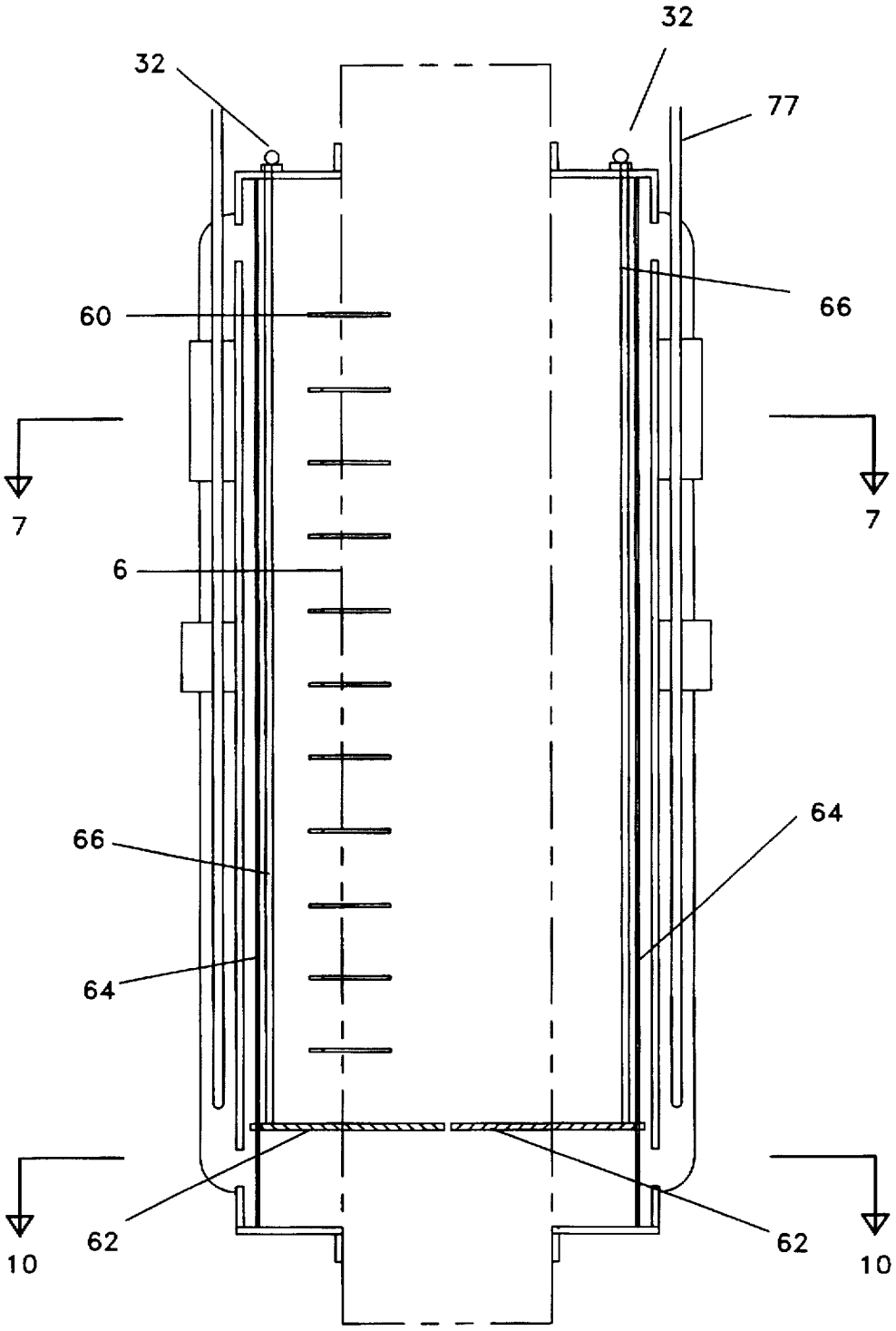
FIG. 6 is a sectional view of a portion of a preferred form of the present invention taken along line 6—6 of FIG. 2.

Referring now to FIG. 6 which is a sectional view of the instant invention taken along line 6—6 of FIG. 2; there is a ladder 60 on the inside surface of said hatch shell 12 and said shell 14 running from the bottom of the habitat to the top. There are also two elevator plates 62 which are slideable within a plurality of elevator rails 64. The elevator plates 62 are connected to the elevator winches 32 by means of two elevator cables 66 such that said elevator winches 32 may be used to raise and lower said elevator plates 62 along the elevator rails 64.

Figure 7:
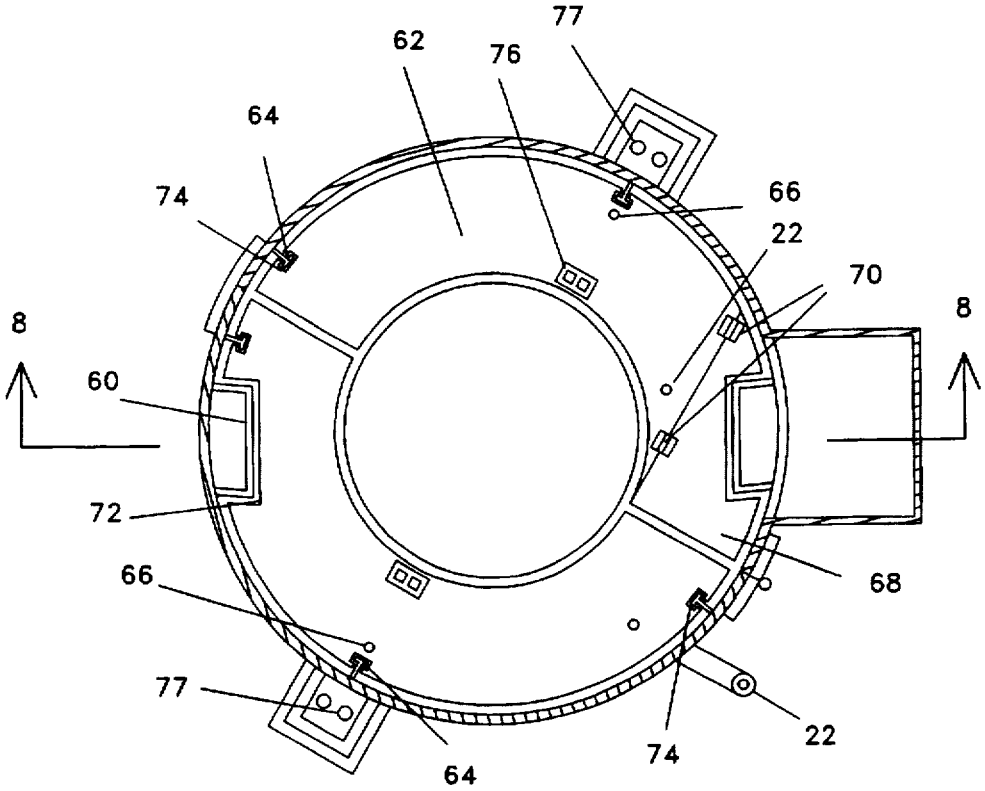
FIG. 7 is a sectional view of a portion of a preferred form of the present invention taken along line 7—7 of FIG. 6.

Referring now to FIG. 7 which is a sectional view of the instant invention taken along line 7—7 of FIG. 6; details of said elevator plates 62 and said elevator rails 64 are shown. There is an elevator door 68 in one of said elevator plates 62 which may be opened and closed using elevator hinges 70. Each of said elevator plates 62 includes a ladder notch 72 to accommodate the two ladders 60. Each of said elevator plates 62 also includes a plurality of rail notches 74 aligned with said elevator rails 64 such that said elevator plates 62 are slideable along said elevator rails 64. There are two sets of foot operated elevator controls 76, one in each of said elevator plates 62, which may be used to raise and lower said elevator plates 62 independently. Said umbilical 22 splits and each of the split ends is affixed to one of said elevator plates 62. Said umbilical 22 consists of a bundle of conduits for providing a variety of services to the habitat which may include electricity, communications, television transmission, and a specially created gas mixture which allows for welding in a safe environment. Said umbilical 22 bundle is covered by protective sheathing which is preferably canvas to prevent damage to the conduits. There are also cooling tubes 77 which run through most of the length of said air ducts 24. The upper ends of the cooling tubes 77 are connected to the surface such that coolant may be pumped through them. Another view of said cooling tubes 77 is provided in FIG. 6.

Figure 8:
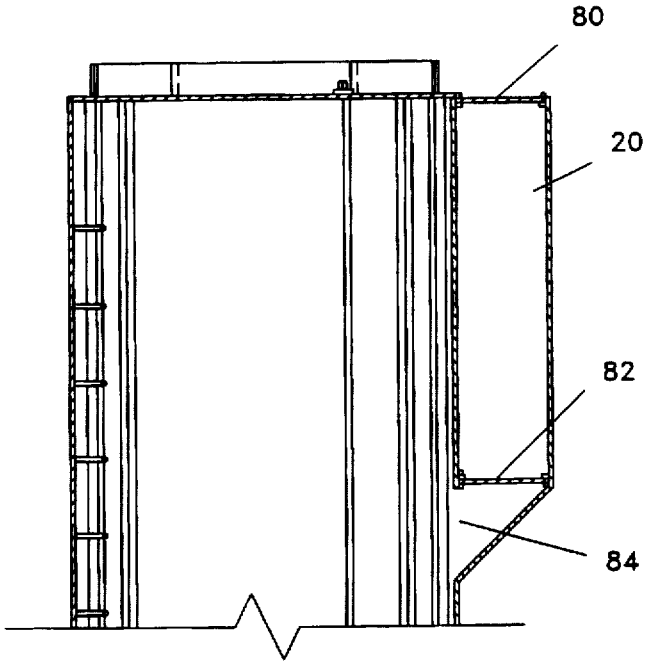
FIG. 8 is a partial sectional view of a portion of a preferred form of the present invention taken along line 8—8 of FIG. 7.

Referring now to FIG. 8 which is a partial sectional view of the instant invention taken along line 8—8 of FIG. 7; details of said hatch 20 are shown. Said hatch 20 includes a top door 80 on its top and a bottom door 82 near its bottom. There is also a hatch hole 84 in the surface of said hatch shell 12 which places the interior of the habitat in communication with the interior of said hatch 20.

Figure 9:
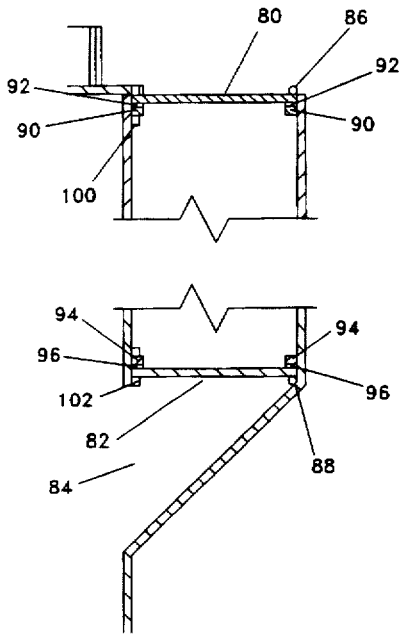
FIG. 9 is a detail view of a portion of FIG. 8.

Referring now to FIG. 9 which is a detailed view of a portion of FIG. 8 further details of said hatch 20 are shown. The top door 80 is attached to said hatch by a top hatch hinge 86 such that said top door 80 may be opened upward with the end of said top door 80 closest to said hatch shell 12 swinging up and away from said hatch shell 12. The bottom door 82 is attached to said hatch 20 by a bottom hatch hinge 88 such that said bottom door 82 may be opened by swinging the end of said bottom door 82 closest to said hatch shell 12 down and away from said hatch shell 12. There is a top hatch lip 90 in said hatch 20 around the exterior edges of said top door 80 and beneath said top door 80 and a top hatch seal 92 between the top hatch lip 90 and said top door 80. There is a bottom hatch lip 94 in said hatch 20 around the exterior edges of said bottom door 82 and above said bottom door 82 and a bottom hatch seal 96 between the bottom hatch lip 94 and said bottom door 82. There is a top hatch latch 100 with which said top door 80 may be opened from the inside or from the outside and a bottom hatch latch 102 with which said bottom door 82 may be opened from the inside or from the outside.

Figure 10:
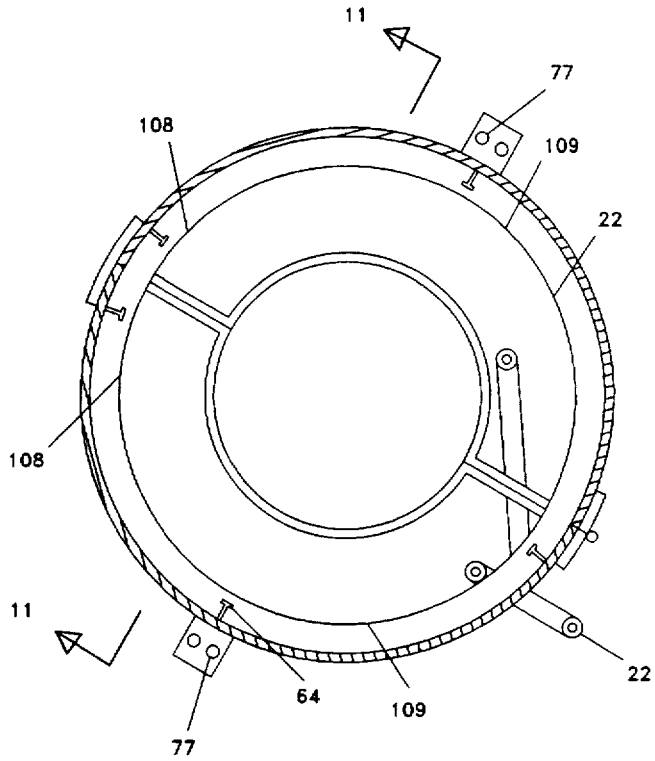
FIG. 10 is a sectional view of a preferred form of the present invention taken along line 10—10 of FIG. 6.

Referring now to FIG. 10 which is a sectional view of a preferred form of the instant invention taken along line 10—10 of FIG. 6, two bottom collars 108 are shown which fit around said riser 6. This Figure also shows the split in said umbilical 22 and the split ends which are attached to each of said elevator plates 62. The bottom of the habitat is open and may be entered through openings 109.

Figure 11:
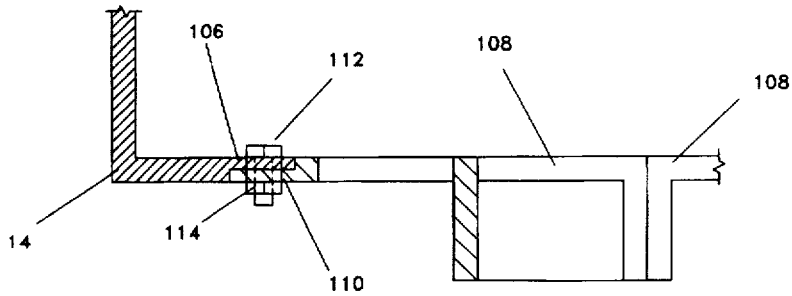
FIG. 11 is a partial sectional view of a portion of a preferred form of the present invention taken along line 11—11 of FIG. 10.

Referring now to FIG. 11 which is a partial sectional view of the instant invention taken along line 11—11 of FIG. 10, the bottom of said hatch shell 12 and said shell 14 are largely open. There is a bottom shell lip 106 around the inside of the bottom of said hatch shell 12 and said shell 12. There are two a bottom collars 108 on of which is attached to said hatch shell 12 and said shell 14 and which serve to stabilize the bottom of the habitat by fitting snugly around said riser 6. The bottom collars 108 have bottom lips 110 around there circumferences. Said bottom collars 108 are affixed to said hatch shell 12 and said shell 14 by means of a plurality of bottom bolts 112 which pass through bottom holes 114 through bottom shell lips 106 and bottom lips 110.

In operation said hatch shell 12 and said shell 14 are placed around the affected area of said riser 6 and surround the leaking, damaged, or weakened area of the riser. Said latches 30 are used to close the habitat firmly around said riser 6 and the seals, said top collar seals 34 and said shell seals 40 provide an enclosed environment. Said braces 10 are affixed to said leg 4 and the habitat to hold the habitat in place and to prevent the habitat from stressing said riser 6. The habitat is then filled with air using said umbilical 22. At this point both said top door 80 and said bottom door 82 in said hatch 20 are closed and said top hatch seal 92 and said bottom hatch seal 96 make said hatch 20 air and water tight. A technician may then enter said hatch 20 through said top door 80. Said top door 80 is then closed using said top hatch latch 100 and said bottom door 82 is opened using said bottom hatch latch 102 and the technician enters the habitat through said hatch hole 84. Said bottom door 82 is then closed. Said blowers 26 circulate the air through the habitat and said scrubbers 28 purify the air. Coolant from the surface is pumped through said cooling tubes 77 as needed to cool the interior of the habitat. The technician may perform the repairs inside the safe and comfortable habitat using either said ladders 60 or said elevator plates 62 to move up and down the inside of the habitat. Said elevator door 68 provides a means for moving either above or below said elevator plates 62 in the event such movement becomes necessary. Entry through said hatch 20 is preferable, but entry is also possible through the openings 109 and said door 68 in one of said elevator plates 62. Said top collars 16 and said bottom collars 108 are removable and the habitat may be adapted for use with risers of various diameters by using top collars 16 and bottom collars 108 having various interior diameters.

When welding or other repair operations may involve a risk of explosion; the habitat is filled with an inflammable, non explosive atmosphere so those operations may be completed safely.

In the preferred embodiment of the pipeline repair habitat all parts, unless otherwise listed below, are made from steel; but other materials having sufficient strength, rigidity, corrosion resistance, and weldability could be used. Said hinges 18, said blower 26, said scrubber 28, said winches 32, said bolts 42, said elevator cables 66, said elevator controls 76, said top hatch hinge 86, and said bottom hatch hinge 88 are all conventional and readily available from a variety of sources. All seals are made from tough, resilient plastic, but other gasket materials could be used.

Although pairs of said air ducts 24, elevator plates 62, and ladders 60 are shown; the habitat could be used with only one of each of these features.

While preferred embodiments of this invention have been shown and described above, it will be apparent to those skilled in the art that various modifications may be made in these embodiments without departing from the spirit of the present invention. For that reason, the scope of the invention is set forth in the following claims:

I claim:

1. A habitat which may be used for repairing a leaking, damaged, or weakened area in a pipe section in a vertical underwater pipeline or riser comprising:

(1) a shell having a top and a bottom and having the general shape of a cylinder; the shell having a diameter sufficiently larger that the underwater pipeline or riser that a person may move about within said shell to make repairs upon the underwater pipeline or riser and having sufficient length that the leaking, damaged, or weakened area may be completely enclosed within said shell; said shell being configured such that the top of said shell forms an air and water tight seal around the underwater pipeline or riser above the leaking, damaged, or weakened area and said shell completely enclosed the leaking, damaged, or weakened area; and said shell being split vertically to create two halves;

(2) a plurality of hinges along one side of which connect the two half shells; and (3) a plurality of latches along the side of the two half shells opposite the hinges such that the two half shells may be opened and closed about the hinges and, if closed, may be held together to form a hollow cylinder using the latches;

whereby the two half shells may be closed around a leaking, damaged, or weakened area in a pipe section in a vertical underwater pipeline or riser using said hinges and held together using said latches and an air an water tight habitat is formed which encloses the leaking, damaged, or weakened area and in which a person may perform repairs of the leaking, damaged, or weakened area.

2. The habitat of claim 1 in which means is provided to introduce an atmosphere into the inside of said shell which may be breathed and in which welding may be safely accomplished.

3. The habitat of claim 2 in which elevator means is provided such that persons working within the habitat may use the elevator means to move up and down within the habitat.

4. The habitat of claim 2 in which said shell is provided with a hatch through which entry to the interior of said shell may be accomplished without disruption of the atmosphere within said shell.

5. The habitat of claim 4 in which elevator means is provided such that persons working within the habitat may use the elevator means to move up and down within the habitat.

* * * * *